United States Patent [19]

Collins

[11] Patent Number: 4,856,192

[45] Date of Patent: Aug. 15, 1989

[54] ADAPTER FOR KNIFE AND SHEATH ASSEMBLY

[75] Inventor: Walter W. Collins, North, S.C.

[73] Assignee: Wenoka Seastyle, West Palm Beach, Fla.

[21] Appl. No.: 149,529

[22] Filed: Jan. 28, 1988

[51] Int. Cl.[4] ..... B26B 29/02

[52] U.S. Cl. ..... 30/151; 30/143; 224/232

[58] Field of Search ..... 30/143, 151, 164, 296 A; 7/167; 224/232

[56] References Cited

U.S. PATENT DOCUMENTS

| | | | |
|---|---|---|---|
| 2,783,536 | 3/1957 | McQueary | 30/151 |
| 2,901,823 | 9/1959 | Widen | 30/151 |
| 4,404,747 | 9/1983 | Collins | 30/151 |
| 4,435,868 | 3/1984 | McQueen | 30/151 X |
| 4,558,516 | 12/1985 | Collins | 30/151 |

*Primary Examiner*—Douglas D. Watts
*Assistant Examiner*—Michael D. Folkerts
*Attorney, Agent, or Firm*—Wolf, Greenfield & Sacks

[57] ABSTRACT

A sheath and knife combination providing an interlocking fit when the knife is inserted into the sheath. The sheath is provided with two upward extensions having a resilient leaf on one extension oppositely facing a hole on the other extension. The knife has two buttons disposed on opposite surfaces of the knife handle and connected by a shaft. When the knife is fully inserted into the sheath, the leaf contacts one of the buttons thereby forcing the opposing button into the hole so that the knife and sheath become interlocked. The knife may be removed from the sheath by pushing the button which engages the hole and pulling the knife out of the sheath.

7 Claims, 2 Drawing Sheets

ADAPTER FOR KNIFE AND SHEATH ASSEMBLY

SUBJECT MATTER OF INVENTION

The present invention relates to a locking system for inter-engaging knives and tools with sheaths.

BACKGROUND OF INVENTION

It is frequently desirable to provide means for positively locking a knife or other tool in a sheath. Commonly available designs providing such function include sheaths with straps having snap lock fasteners to engage the handle of the knife or tool. Other systems are illustrated in my co-pending application Ser. No.: 115,059 filed Oct. 30, 1987. As pointed out in my co-pending application, these systems are not altogether satisfactory, especially when such tools, knives and sheaths must be used under adverse environmental conditions. Certain considerations are particularly important when the knife or tool is used in underwater environments such as a scuba diver might encounter. Under such circumstances, the system must provide means for easy insertion and securing of the knife or tool in the sheath while also providing means for quick release.

Therefore, one object of the present invention is to provide an improved means for securing a knife in a sheath with components of the securing mechanism in part formed by the sheath and in part formed by the knife or tool.

A further object of the present invention is to provide an improved means for adapting a knife, previously designed for insertion in only one orientation into a locked position in a sheath to an arrangement in which the knife or tool may be inserted and secured in a sheath in two orientations.

A further object of the present invention is to provide means for interlocking, in a sheath, a tool or knife with either surface of the tool or knife facing outwardly.

Another object of the present invention is to provide an improved system for disassembling, cleaning and replacing an interlocking mechanism for a knife and sheath.

SUMMARY OF INVENTION

The present invention provides an improved means for securing knives and tools in a sheath particularly adapted for use in adverse environmental conditions such as underwater. The sheath/knife combination of the present invention allows the knife to be inserted into the sheath in an inter-locked manner with either surface of the knife facing outward. This is accomplished by providing the sheath with a resilient leaf oppositely facing a hole. The knife is provided with two buttons disposed on opposite surfaces of the knife handle and connected via a shaft. The leaf/hole structure of the sheath is disposed on the sheath so that when the knife is inserted, the leaf contacts one of the buttons forcing the opposing button into the hole so that the knife and sheath become interlocked. To disengage the knife from the sheath, the user will push the button which engages the hole, so that it disengages the hole thereby forcing the opposite button against the resilient leaf which will flex under the force and allow the knife to be pulled out of the sheath.

DETAILED DESCRIPTION OF THE DRAWINGS

The foregoing objects and advantages of the present invention will be more clearly understood when considered in conjunction with the accompanying drawings in which FIG. 1 is a plan view of a knife and sheath combination emboding my invention.

DETAILED DESCRIPTION OF INVENTION

Figure 1:
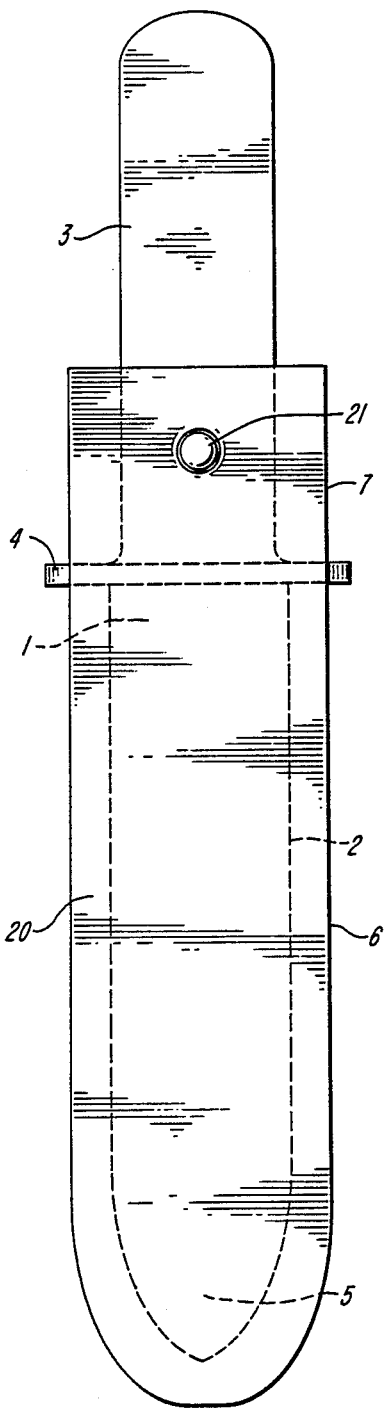
Figure 2:
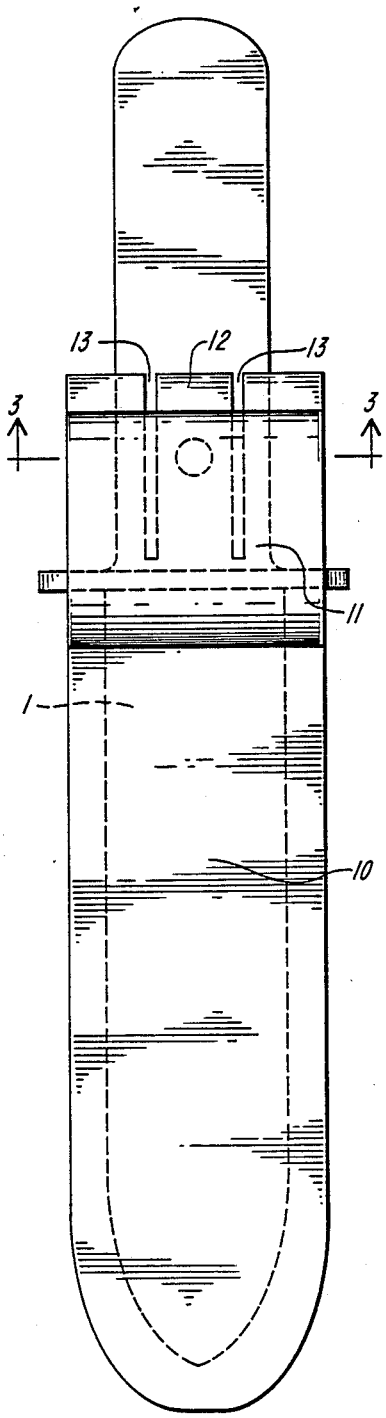
FIG. 2 is a plan view from the opposite side of that shown in FIG. 1.
Figure 3:
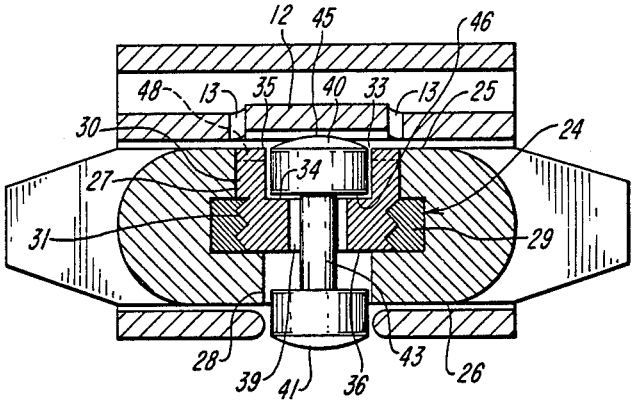
FIG. 3 is a cross-sectional view taken along line 3—3 of FIG. 2.

A knife 1 is conventionally formed with a blade 2, handle 3 and guard 4 of conventional and suitable material. In the preferred embodiment the blade is symmetrically formed as illustrated at 5. A sheath 6 is also symmetrically formed to encase the blade 2. The sheath extends upwardly with extensions facing at least the lower portion of the handle 3. The inner surface of the sheath 6 is designed to face the body of the wearer and may be provided with a loop 11 for engaging a belt (not shown). The upper end of the inner surface 10 is formed with an elongated leaf 12 defined by a pair of parallel slits 13 that extend downwardly from the upper end of the extension 7. The leaf 12 is made of a material that has spring-like quality and thus may be made of a relatively stiff resilient material such as spring steel or plastic. The leaf 12 may be made integrally with the remaining portion of the sheath 6, provided it exhibits spring-like characteristics as described. Preferably, therefore, the sheath 6, including the leaf 12, is made of injection molded plastic. A suitable plastic is particularly desirable if the sheath and knife are to be used for underwater purposes. The characteristics of the sheath material should be such that the leaf can be deflected under force from a plane coextensive with the remaining portion of the extension 7 of the inner surface 10, and is adapted to return to its original position when the force is released, as illustrated in FIG. 3.

The extension 7 of the outer surface 20 is formed with a hole 21 aligned with the leaf 12.

The knife handle 3 is formed with a hole 24 that extends from the inner side 25 to the outer side 26 of the handle. The hole has an enlarged diameter 27 on the inner side and a smaller diameter 28 on the outer side. If desired, the center portion may be formed with an internally threaded ring 29. The inner diameter of the ring 29 is greater than the diameter 28 but less than the diameter 27.

A cylindrical nut 30 having external threads 31 at one end fits within the hole 24 in the enlarged diameter 27 with the external threads 31 of the nut 30 engaging the internal threads of the ring 29. The cylindrical nut 30 is formed with an opening 33 extending axially therethrough. A shoulder 34 is formed substantially midway between the inner side 35 and outer side 36 of the nut 30. The shoulder 34 thereby forms a constricted center passage 39 in the opening 33.

A pair of buttons 40 and 41 are interconnected by a shaft 43. The buttons 40 and 41 each have a diameter slightly smaller than the diameters 27 and 28 respectively in order to permit reciprocal sliding of the buttons. Button 40 is adapted to slide axially in the portion of opening 33 between shoulder 34 and inner side 35, while button 41 is adapted to slide axially in the portion of opening 33 between outer surface 26 and outer surface 36. To achieve this sliding action, button 40 should have a thickness from the center of the domed portion 45 to the opposite surface 46 no greater than the distance between shoulder 34 and inner side 35. Likewise, the thickness of button 41 should be no greater than the distance between outer side 36 and outer side 26, thereby permitting complete recessing of button 41 within this space under a positive force for disengagement of the button 41 within hole 21.

Figure 4:
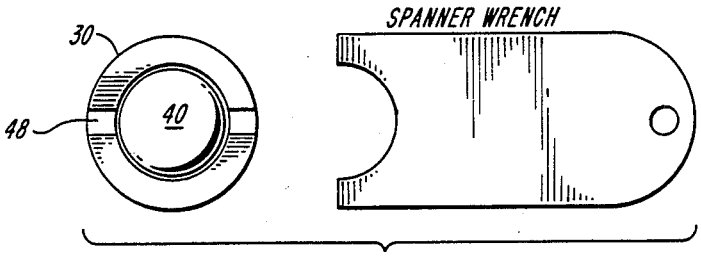
FIG. 4 is a plan detail of a component shown in FIG. 3.

The cylindrical nut 30 may be provided with screw slots 48 as illustrated in FIG. 4 for ease in assembly with a conventional spanner wrench.

In use, one may insert the knife within the sheath 6 with the inner side 25 or outer side 26 facing the leaf 12. As the knife slides into the sheath 6, the spring tension of leaf 12 engages the adjacent head of the button 40 or 41 and forces the opposite button into an interfering fit with hole 21. The knife may thus be inserted in either direction within the sheath and automatically locked when the buttons 40 and 41 become aligned with the leaf 12 and hole 21. To remove the knife from the sheath, the user need only apply pressure with a finger to the button in interfering engagement with hole 21 until the button within hole 21 has cleared the hole thus permitting vertical movement of the knife.

Figure 5:
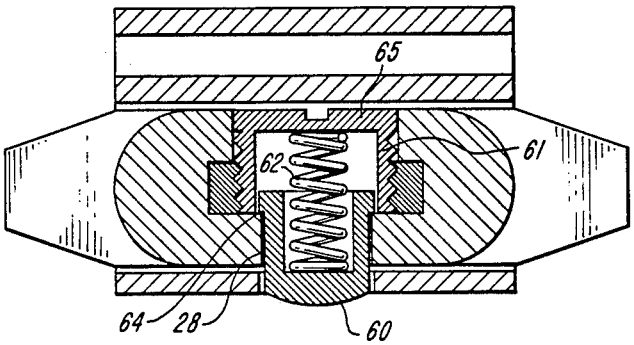
FIG. 5 is a cross-sectional view of an original design of which the embodiment of FIG. 3 is an improvement, taken substantially along the same line as FIG. 3.

FIG. 5 illustrates an earlier version of the knife and sheath interlock in which the knife could be inserted in one direction only. In this arrangement the button 60 is axially slidable within a cylindrical nut 61 and is normally maintained under tension in the direction away from the nut 61 by helical springs 62. The smaller diameter 28 of the hole engages a flange 64 on the nut of the button 60 to limit its outward movement. The cylindrical nut 61 has a closed slotted end 65 that permits use of this arrangement to secure the knife or tool in only one orientation within the sheath. This system may be replaced with the system of the present invention by removing nut 61 and button 60 and substituting therefore the nut and button assembly illustrated in FIG. 3. Because of the interchangability of these two systems, a factory fabricated knife or tool of the type illustrated in either FIGS. 3 or 5 can be fitted selectively with an interlock sheath of the type shown in either FIG. 3 or FIG. 5.

What is claimed is:

1. A means for interlocking a tool and a sheath comprising:

locking means disposed on said tool having a pair of members adapted to be alternately moved into an interfering fit with a portion of said sheath, wherein said pair of members comprises a pair of buttons, and a shaft rigidly interconnecting said buttons, means disposed on said sheath for actuating said locking means on insertion of said tool into said sheath including means for engaging either one of said pair of buttons depending upon the orientation of said tool on insertion into said sheath for actuating said locking means whereby the other if said pair of buttons engages a portion of said sheath in an interfering fit, and said tool has means formed therein for supporting said shaft for limited reciprocal axial movement between positions in which a different one of said buttons projects beyond the surface of said tool with said projecting button comprising the button which engages a portion of said sheath in an interfering fit.

2. Means as set forth in claim 1 wherein said means disposed on said sheath comprises first and second extensions projecting upwardly form the side of said sheath, said first extension forming said means for engaging a member for activating said locking means.

3. Means as set forth in claim 2 wherein said second extension is parallel to and at least partially coextensive with said first extension, said second extension having an opening therein aligned to receive one of said buttons in interfering fit on insertion of the tool into said sheath.

4. Means as set forth in claim 3 wherein said means formed in the handle for supporting the shaft comprises a hole and means forming a construction within said hole, said shaft extending through said construction and said buttons having a greater diameter than said shaft and lying on either side of said construction.

5. Means as set forth in claim 4 wherein said means forming a construction comprises a nut having an opening therethrough, said opening having first and second segments having a diameter sized to receive said buttons and a third segment with a smaller diameter disposed between said first and second segments and surrounding said shaft.

6. Means as set forth in claim 5 wherein said nut is externally threaded.

7. Means for interlocking a knife within a sheath irrespective of the knife blade surface orientation comprising:

said sheath having a pair of upwardly projective extensions oriented to face opposite surfaces of the handle of the knife when the knife is fully inserted in the sheath, with one of said extensions forming a leaf spring adapted to exert a force toward said handle and the other of said extensions having a hole aligned with said first extension, said knife having a handle with a hole extending therethrough aligned with said leaf spring and said hole in said extensions, and a pair of buttons interconnected by a shaft positioned within said handle hole, and means supporting said shaft providing limited axial movement of said shaft to a position in which one button is fully recessed within the handle and the other projecting beyond a surface of the handle such that when said knife is fully inserted in said sheath, said leaf spring engages one button and causes axial movement of the other into said hole in said extension.

* * * * *